US005750462A

United States Patent [19]

Gundjian

[11] Patent Number: 5,750,462

[45] Date of Patent: May 12, 1998

[54] LATENT IMAGE PRINTING PROCESS AND APPARATUS AND SUBSTRATE THEREFOR

[75] Inventor: Arshavir Gundjian, Montreal, Canada

[73] Assignee: Nocopi Technologies, Inc., Wayne, Pa.

[21] Appl. No.: 360,860

[22] Filed: Dec. 21, 1994

Related U.S. Application Data

[60] Division of Ser. No. 996,550, Dec. 24, 1992, Pat. No. 5,424,266, which is a continuation-in-part of Ser. No. 808,331, Dec. 16, 1991, abandoned, which is a continuation-in-part of Ser. No. 685,575, Apr. 15, 1991, abandoned.

[51] Int. Cl.[6] ..... B41M 5/30

[52] U.S. Cl. ..... 503/201; 430/9; 430/42; 430/56; 430/151; 430/200; 503/204; 503/206

[58] Field of Search ..... 503/201, 204, 503/206; 430/9, 42, 56, 151, 200

[56] References Cited

U.S. PATENT DOCUMENTS 3,840,385 10/1974 Yoshida ..... 430/45

4,869,981 9/1989 Wing et al. ..... 430/42

*Primary Examiner*—Bruce H. Hess

*Attorney, Agent, or Firm*—Sprung Kramer Schaeer & Briscoe

[57] ABSTRACT

A latent image printing method and apparatus uses a substrate with one main surface having a covering comprising only one of a first pair of a color developer and color former dye in at least one selected latent imaging area defining a background color in conjunction with the one main surface, wherein the color developer and the color former dye react when mixed to produce a first spectral response which is visible relative to the background color and a continuous coating over the covering which is non-porous with respect to the other of the pair and solvent-resistant to the other of the pair. The coating above selected portions of the covering corresponding to a desired latent image is removed.

6 Claims, 2 Drawing Sheets

LATENT IMAGE PRINTING PROCESS AND APPARATUS AND SUBSTRATE THEREFOR

This application is a divisional of application Ser. No. 07/996,550, filed Dec. 24, 1994, now U.S. Pat. No. 5,424,266 which is a continuation-in-part application of application Ser. No. 07/808/331, filed Dec. 16, 1991 and now abandoned, which is a continuation-in-part application of application Ser. No. 07/685,575, filed Apr. 15, 1991 and now abandoned.

BACKGROUND OF THE INVENTION

This invention relates to a printing method and system whereby the information printed on a substrate, such as paper, is transferred in the form of a latent image or "secure image" which is invisible to the eye and any other usual image detecting device at the time of printing and is revealed only after the substrate is subjected to a subsequent process of image activation. This invention is also interpreted as providing a system whereby the initial process of information printing instantly seals and secures the printed message in a way equivalent to the centuries old process of securing printed information by enclosing a letter in an opaque envelope, without the need of an "envelope". The subsequent process of image activation corresponds to the classical process of "tearing the envelope" to reveal the enclosed message or information.

It is understood of course that over the whole time of the history of printing inks, a search and a fascination for invisible inks has always existed. Many such ink systems have been found, developed and used in a limited way mainly because of the limited accessibility of such invisible inks and delivery systems for the latter.

SUMMARY OF THE INVENTION

The object of this invention is to develop a special composite chemical coating system utilizing presently readily available materials that can be easily applied to a paper or any other substrate in large volume configurations, such that said paper can be utilized in presently widely used machines for telecopying, printing or typing and result in printed invisible information, i.e., "secure information" in a latent image state, hence sealed and secured from the eye and any other viewing and copying device, until it is subjected to a simple image activation process, which "breaks the seal" or the protective veil and reveals the printed message.

A very wide use of this invention is expected to be in the area of telecopiers. Presently it is well acknowledged that a great disadvantage of telecopiers resides in the complete absence of any protection or privacy of messages and documents transmitted by those machines. The present invention provides a most convenient and effective solution to this problem. Indeed when commonly used thermal fax paper is replaced by this novel latent image printing substrate or paper according to the present invention, the received fax information will be transferred to this paper but will remain invisible and therefore sealed and secure until an authorized person subjects the paper to the activation process. Many variations of this basic invention can easily be visualized and are all intended to be covered by this invention.

In one implementation of the invention, the latent imaging process is confined to one or more selected parts of the sheet, while the remaining surface of the sheet is treated with one of the appropriate coating systems which allows it to develop normal visible images by the particular imaging process that is being used, i.e., impact printing, thermal printing, facsimile printing and copier printing. The latent imaging area is preferably a central area so that visible images can be produced in the margins of the sheet or on predetermined blocks of the paper and the secure information will be printed (as a latent image) on the remaining portions of the sheet.

DETAILED DESCRIPTION OF THE INVENTION

As stated above, invisible ink systems have been used for centuries. As is known, a colorless liquid A is used to write on a document which thus results in an invisible text. At the receiving end the traces of the colorless liquid A are revealed or rendered visible by either applying a second or activating liquid B to the paper or, for example, by applying heat depending on the nature of the chemical A.

The present invention can use any one of the known A,B chemical combinations that can act in the manner described above.

In a particularly advantageous embodiment of the invention, it is particularly convenient to utilize the well known combination of any one or a combination of leuco dyes, such as, Copikem-1, otherwise identified as 3,3-Bis (4-dimethylaminophenyl)-6-dimethyl phthalide, from Hilton-Davis Co. of Cincinnati, Ohio, Copikem-4, otherwise identified as 2-Anilino-3-methyl-6-diethyl aminofluoran from Hilton-Davis, and PSD-150, otherwise identified as 3-Cyclohexyl methyl amino-6-methyl-7-Anilinofluoran from Nippon Soda Co. of Tokyo, Japan, widely used in the carbonless or thermal paper industry, acting as chemical A, and any one of the well known corresponding activators or developers such as, zinc chloride, ferric chloride and Novalac resins such as HRJ-4002 and HRJ-2609 from Schenectady Chemicals of Albany, N.Y., acting as chemical B.

Figure 1:
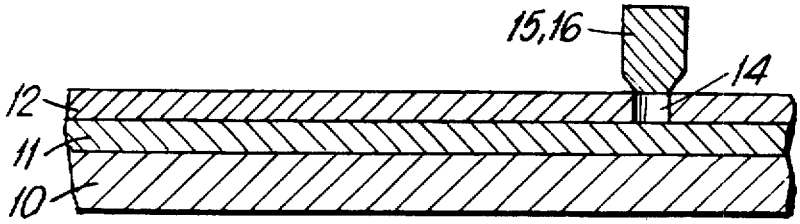
FIG. 1 is a cross sectional view of a substrate in accordance with the present invention in use with a latent image process and apparatus according to the invention.

The chemical A or B is then coated onto a substrate such as mylar, paper or the like. A specific substrate such as particularly a paper sheet substrate 10 shown in FIG. 1 is coated with a first film 11 which consists of the chemical A or B blended in an appropriate binder which provides a good adhesion of the film 11 onto the substrate 10.

Next a second thin film 12 is laid down on the film 11. The film 12 is specified to have a number of critical properties, as follows:

1. The thin film 12 must provide a continuous i.e. non-porous impermeable protective covering to film 11 such that any liquid and particularly the carrier for the complementary chemical B or A (see below) applied on film 12 shall not be allowed to mechanically penetrate it and hence reach coating 11.

2. The thin film 12 must be solvent resistant, particularly to the specific solvent used for the complementary chemical B or A which shall be used as the activating agent at the stage where the latent image is to be revealed depending on whether chemical A or B is utilized in the layer 11 of the composite coating structure.
3. The thin film 12 has a low melting point $T_m$ of the order of 100° C., that is from 50° to 200° C., preferably 50° to 150° C., more preferably 60° to 110° C. and most preferably from 65° to 95° C., such that upon local application of heat by thermal printing element 15 on thin film 12 as the temperature reaches $T_m$, the coating "melts" and opens a window 14 in thin film 12 which now will allow the penetration of a liquid, such as specifically the activating agent carrying solvent referred to above, when the latter is applied onto the surface of the substrate.
4. The thin film 12 has a thickness which is sufficiently thin, of the order of a micron, that is 0.1 to 10μ, more preferably 0.1 to 3μ and most preferably 0.1 to 1μ, such that a mechanical pressure applied locally, with a pencil- or pen-like device as well as the head 16 of an impact printer such as a typewriter, will easily break it and open a window 14.

Figure 2A:
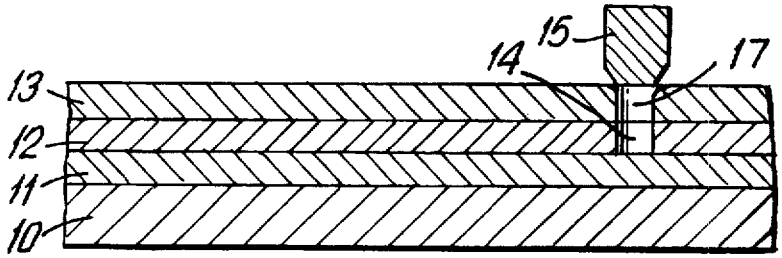
FIGS. 2*a* and 2*b* are cross sectional views of alternative embodiments according to the present invention.
Figure 2B:
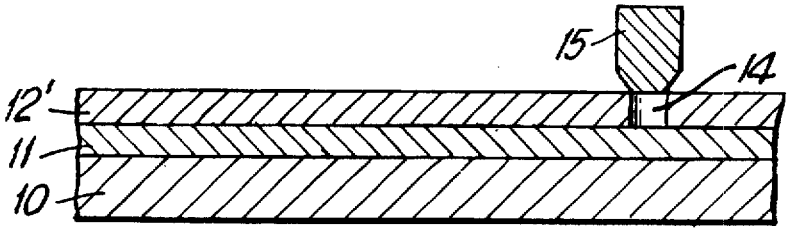

When the composite coating system according to the present invention is predetermined to be utilized in applications uniquely related to telecopiers (i.e. fax machines), the addition of another constituent may be desirable as shown in FIGS. 2*a* and 2*b*. The film 12 is thus overcoated with a film 13 consisting of a commercially known sensitizer commonly used in the thermal paper industry, for example, dibenzoyl terephthalate (DBT) from Nippon Soda Co. of Tokyo, Japan, paraffin wax and wax blends from Amoco, Ind., USA. Such sensitizers have the property of being in an inert solid state at room temperature. Upon heating to up to a critical temperature $T_c$ of the order of 100° C. under the telecopier head, the sensitizer melts at 17 and acts as a solvent which is intended here to help further with the opening of the window 14 in film 12 as described above. This requires of course that film 13 act as a solvent for film 12 which otherwise is specified to be resistent to the specific solvents used for the activating agent as described above. It is also possible to combine films 12 and 13 into a single composite protective and heat sensitive film 12' as shown in FIG. 2*b*.

Figure 3:
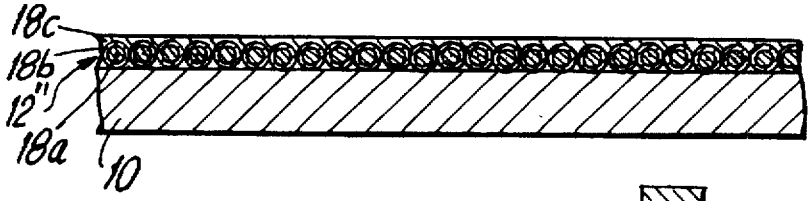
FIG. 3 is a cross sectional view of another embodiment of the present invention.

In yet another embodiment shown in FIG. 3 the chemical A or B is laid down as film 12" composed of microcapsules 18 utilizing the widely known technology of microencapsulation with the capsule walls playing the role of the film 12 and hence having to comply with the requirements placed on 12 as described above and chemical A or B in microcapsules 18 acting as layer 11.

The latent image printing substrate is prepared by coating a paper web 10 having a white background, with the layer 12" comprising a mixture containing microencapsulated leucodye 18*a* encapsulated in heat sensitive walls 18*b* made of material of layer 12" and integrated with a binder 18*c* to a thickness of two microns.

The web then be wound on a roll and placed in a fax machine. The fax machine imprints the text on the coating while breaking the capsules and exposing the leucodyes. This forms the latent image.

The latent image, the text, is then developed by applying a developer by means of a roller impregnated therewith.

The latent image printing process and apparatus according to the invention for generating a latent image invisible to the eye and other document reading devices, will now be described in connection with a substrate coated following the prescriptions set forth above.

In any embodiment described above it is possible that the invisible printing process which generates indentations in layers 12, 12', 12" or 13 in FIGS. 1, 2*a*, 2*b* and 3 will result in a trace that under hard scrutiny is visible to the eye. It is, therefore, proposed that the surface of the substrate 10 or the film 11, 12 12', 12" or 13 of FIGS. 1, 2*a*, 2*b* or 3 be overprinted with a very lightly visible "scrambler" pattern which does not interfere to any appreciable extent with the reading process but hides most conveniently any eventual trace of indentations.

Figure 6:
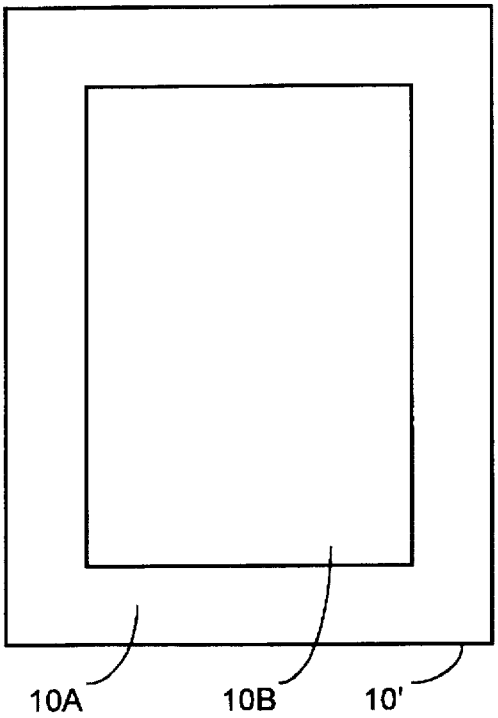
FIGS. 6 and 7 are top views of alternative embodiments of the substrate in accordance with the invention with selective latent imaging.
Figure 7:
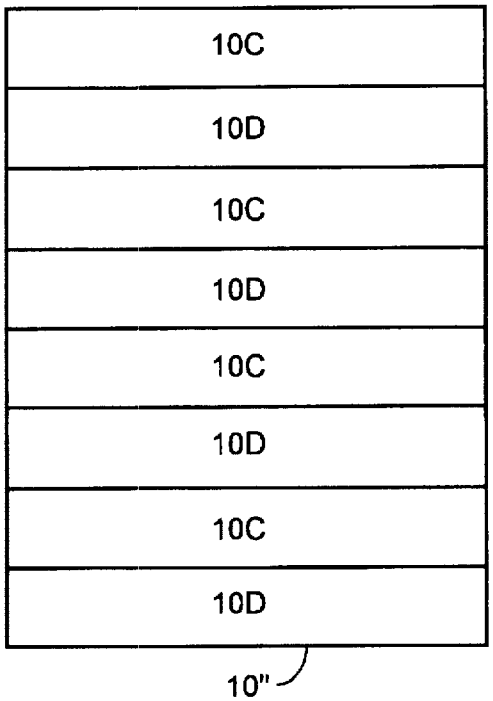

As will be evident, the coated substrate can be prepared to provide selective latent imaging. Specifically, only selective portions of the surface of the substrate are coated with film 11, 12, film 11, 12, 13, film 11, 12' or film 12" and the remaining portions of the surface are coated with conventional films containing both chemicals A and B which achieve a visible image. As shown in FIG. 6, the substrate 10' has central area 10B coated with films according to the present invention which will provide a latent image and a marginal area 10A that is coated with a conventional thermal fax paper coating film to provide a visible image. In FIG. 7 alternating areas 10C and 10D are provided on substrate 10" to provide visible and latent images respectively when used. Those of skill in this art will be able to select other patterns for different types of applications.

1. Printing in a Telecopier or Fax machine

At the receiving end of a fax transmission system, the signals received by the fax machine are converted into heat, in machines that use thermal fax paper, at the tips of the printing matrix of the machine which then is applied on the well known thermal fax paper that rolls under this matrix. At the heated spots where the temperature is raised to around 100° C., the sensitizer particles melt and act as a solvent simultaneously to leucodye and developer particles present simultaneously in the coating of the conventional fax paper (i.e. a combination of A & B chemicals described above), thus A and B mix and a color is developed.

In accordance with the present invention, the thermal paper is replaced by the new secure printing paper or substrate described above. It is clear that the printing matrix of the fax machine when activated by an incoming signal to print a document, acts in the way illustrated in FIGS. 1 and 2, thus merely opening tiny windows 14,17 on the paper surface where a character is expected to be printed. Clearly at these locations an open passage is now available towards the layer 11 which is made of only one of either chemical A or B, i.e., for example either a leucodye or a developer as described above.

The paper that comes out of the fax machine will thus remain as clear of any visible traces as when it entered the machine.

In the embodiments shown in FIGS. 6 and 7, the paper that comes out of the fax machine will be clear of any visible traces in areas 10B and 10D, but will clearly have a visible image in areas 10A and 10C.

2. Printing via an impact printer

It is easily visualized that when the secure printing paper is placed in any one of the known types of impact printers such as a typewriter, the impact pressure from the head of the printer along the profile of the character to be printed will break the coating 12 and consequently will create a tiny window 17 offering free passage from the surface of the sheet to layer 11.

It is thus understood that in any of the cases described above the printed document carries the text in the form of exposed portions of the layer 11. Such text is, however, colorless and therefore invisible to the eye or other image detecting devices.

Activation of the text is carried out simply by applying to the printed surface of the "secure printing substrate" the complimentary B or A chemical carrying solvent, by any convenient method. Upon such application it is clear that this solvent will penetrate into the windows 14,17 previously described and will dissolve the primary chemical A or B in layer 11. The mixing of A or B with B or A will produce a visible color, and hence the latent image of the text will become visible and readable.

The activating agent can be applied typically utilizing a marker pen structure such as described in the pending patent application PCTCA9000203 filed Jun. 29, 1990. It can also be applied through a convenient pad impregnated with the activating agent which then is swept over the substrate. Alternatively, the substrate is manually or mechanically pressed onto such a pad and pushed under it to activate the text.

With regard to the embodiments shown in FIGS. 6 and 7, the areas 10A and 10C are coated with conventional films which, when impacted by the printer head, produce a visible image.

In addition to the above, other advantageous embodiments of the secure printing process are considered for impact printers, thermal printers and thermal telecopiers and copies.

Figure 4:
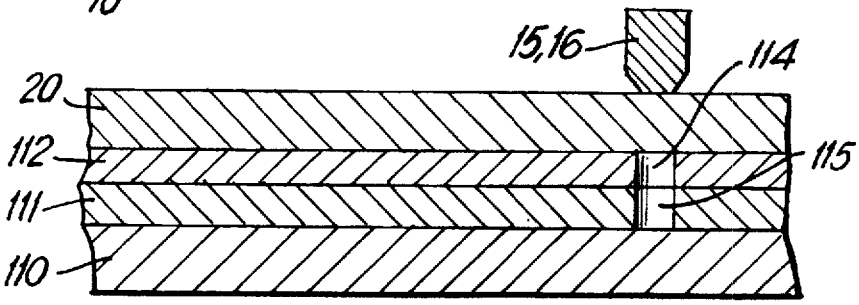
FIGS. 4 and 5 are cross sectional views of other embodiments of the invention.

When utilizing a thermal printer (or any thermal printing device) or an impact printer which is carrying a commonly used printing ribbon, a preferably thin caliper sheet of paper 20, as shown in FIG. 4, is superposed on the "secure substrate" 110 carrying first film 111 of chemical A or B similar to film 11 and second protective film 112 similar to film 12 such that the printing element 15, 16 directly contacts the regular paper 20. The regular paper 20 preferably has a thickness of 25 microns. The pressure or heat is clearly still transferred to the layer 112 on the sheet 110 and the expected process is achieved, because area 114 of layer 112 will crack off or melt and adhere to paper 20. There is also the advantage in this case of generating spontaneously a visible original of the printed text on the inserted ordinary top sheet 20 when an impact printer is used with a ribbon.

Alternatively, the coating 111 can be made to be easily transferrable from substrate 110, as in Example 6, so that for the case of a thermal printer or fax, both area 114 of layer 112 and an area 115 of layer 111 will transfer to sheet 20 as a result of the application of localized heat.

Figure 5:
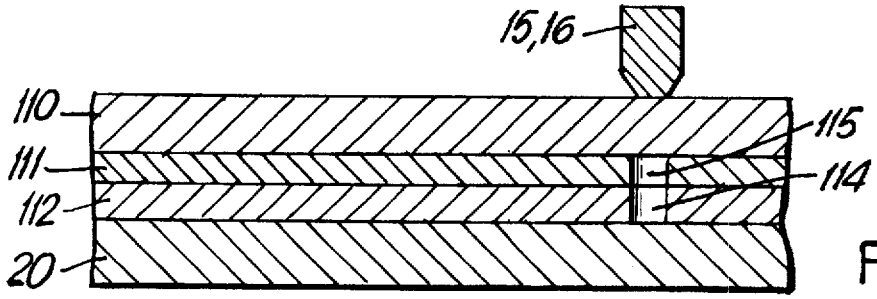

It is also found that the secure printing paper sheet or substrate role can be reversed as shown in FIG. 5. The secure printing substrate 110 is now used as the top surface of a pair where the second sheet 20 is an ordinary paper, such that the coating 111,112 faces the second sheet 20. In this case, the substrate 110 is preferably thin, on the order of 25 microns. The printing element 15,16 contacts the back of sheet 110 from behind the composite coating 111,112, and still causes the layer 112 to break or melt along the pressure profile and transfers area 114 of layer 112 onto the ordinary paper 20 along the profile of the printed characters.

Alternatively, the coating 111 can be made to be easily transferrable from substrate 110 (as in Example 6), so that both area 114 of layer 112 and area 115 of layer 111 will transfer to sheet 20 as a result of the application of localized heat or pressure. The ordinary paper 20 is now carrying the full text in an invisible manner, and can be activated in a way identical to that described above.

It should be noted that in this case the layer 112 of the composite coating need be very thin, preferably a submicron skin of protection which simply prevents the layer 111 from transferring to a superposed surface unless substantial pressure or heat is applied.

With respect to the embodiment of FIGS. 6 and 7, sheet 110 will have films 111 and 112 in areas 10B and 10D and will have conventional coatings in areas 10A and 10C which will enable a visible image to be printed in response to heat or impact. Alternatively, the plain paper sheet 20 can have the other of chemicals A and B coated thereon in areas 10A and 10C to immediately produce a visible image when mixed with the chemical transferred from sheet 110.

In another embodiment, for use in a facsimile machine, the thin sheet 110 has very low basis weight, five pound basis weight, and a thickness of from 10 to 75 microns and which is naturally or made to be translucent. The thin sheet is adhered at its side edges to the plain paper 20. The thin sheet has one of the colorformer and color developer embodied in a binder of low melting point (50° to 200° C.) and covered with a thin skin of 0.1 to 3 microns. When the pair of two sheets is acted upon by a fax machine, a latent image is carried by the plain sheet as well as a visible image developed on selected parts. In addition, the top thin sheet which is glued at the side edges of the plain paper sheet acts as a translucent physical envelope through which the visible image can be seen. The presence of the top sheet will prevent the activation of the latent image by anyone but the addressee, since it must be removed to activate the latent image.

All of the above described selective latent image printing processes and systems according to the invention are convenient techniques whereby chemical A or B is laid down and exposed on the substrate along the profile of the characters or the graphics required to be printed. Moreover, as part of this invention, it has also been discovered that the above process can also be achieved when the available printing system utilizes the well known xerographic process whether in a photocopier, laser printer or plain paper fax machine. In this case, the chemical A or B is integrated into the toner used in the photocopier, laser printer or plain paper fax machine.

The toner consists of a resin which is normally available in a quasi-colorless or transparent formulation. In lieu of the normally used black or colored pigments that are added to the resin and ultimately result in a positively or negatively charged toner, either one of an activator or color former is added to the colorless resin and thus obtains an essentially colorless positively charged single component non-magnetic color former loaded toner and also an essentially colorless negatively charged single component non-magnetic activator loaded toner. Clearly many other combinations where toner is loaded with either component A or B and is essentially colorless can be prepared.

When the toners prepared as described above replace the ordinary toners in a copier, laser printer or plain paper fax machine, a document copied on the copier, printed on the printer or faxed into the fax machine results in a document carrying the information invisibly. In order to render any, be it slight, visibility ineffective, the substrate onto which the printing is to be performed can have its surface preprinted with a light scrambling pattern which then neutralizes visually any traces of the colorless toner printed information.

Finally it is found convenient in this case as well that the latent image printing be selective. This is achieved by coating selective portions of the surface of the otherwise plain paper substrate onto which the information is to be printed, with a coating that contains the other of the chemicals A or B as shown in FIGS. 6 and 7. Thus when the toner carrying A or B is deposited onto such parts of the substrate surface, the combination of A and B immediately produces a visible image.

This invention also covers the preparation of toners where the reactive component A or B is added to ordinary colored pigments in the process of the preparation of the final toner. In this case copying, printing or fax machines loaded with such reactive toners will print a visible image, however, such printed documents are immediately identified when the other of A or B is applied onto the printing with a highlighter or other applicator as a result of the characteristic color change which results from the meeting of chemicals A and B. This process is found to be a very convenient authentification means for printed documents.

EXAMPLE 1

A latent image printing substrate is prepared by coating a web of 15 pound basis weight paper having a white background with a first colorless layer of Novalac resin HRJ-4002 from Schenectady Chemicals and polyvinyl alcohol acting as a binder and having a thickness of 2 microns. A second colorless layer of acrylic copolymer having a thickness of 1 micron and a melting point of 70° C. is continuously coated on the first layer to act as a barrier. A third colorless layer of DBT from Nippon Soda Co. having a thickness of 1 micron and a melting point of 94° C. is coated on the second layer to act as a sensitizer.

The web is wound into a roll and placed in a thermal paper process fax machine Model 2800L from Ricoh Corp. of Japan. A transmission of one page of text is sent to the fax machine. The fax machine records the text on the substrate by heating the coated surface thereof, at points corresponding to the text, to a temperature of about 95° C. which melts the layers of DBT which in turn melts and dissolves the acrylic resin and thus locally removes the same. The fax machine automatically emits one sheet of paper cut from the roll and bearing a latent image of the text which is invisible to the eye.

The latent image is activated by applying the leucodye Copikem-1 in liquid form on the coated surface of the sheet by means of a roller impregnated therewith. The reaction of Copikem-1 and Novalac resin HRJ-4002 in the areas where the DBT and the acrylic copolymer films have been removed results in a color change from colorless to blue which is visible against the white background.

EXAMPLE 2

A first layer of Copikem-1 and polyvinyl acetate and $TiO_2$ acting as a white coloring agent has a thickness of 2 microns and has white color. The second and third layers are the same as in Example 1.

The latent image is formed as in Example 1, and the image is activated by applying the developer HRJ-2609 in liquid form on the coated surface of the sheet by means of a marker pen impregnated therewith. The reaction of Copikem-1 and HRJ-2609 in the areas where the DBT and acrylic films have been removed results in a color change from white to blue which is visible against the white background of the first layer.

EXAMPLE 3

The second and third layers are integrated into a single layer to avoid double coating and the resulting substrate is used as in Example 2.

EXAMPLE 4

A latent image printing substrate is prepared by coating a sheet of 15 pound weight basis paper having a white background with a first colorless layer of Novalac resin HRJ-4002 and polyvinyl alcohol acting as a binder and having a thickness of 2 microns. A second colorless layer of refined paraffin wax having a thickness of 1 micron and a melting point of 65° C. is continuously coated on the first layer to act as a barrier.

The sheet is placed in a IBM typewriter having a printwheel impact printing element and no ribbon. One page of text is typed on the sheet by impacting the coated surface thereof, at points corresponding to the text, which breaks the film of wax and thus locally removes same. The one sheet of paper bears a latent image of the text which is invisible to the eye.

The latent image is activated by applying Copikem-1 in liquid form on the coated surface of the sheet by means of a roller impregnated therewith. The reaction of HRJ-4002 and Copikem-1 in the areas where the wax film has been removed results in a color change from colorless to blue which is visible against the white background.

EXAMPLE 5

The sheet of Example 4 is used in a fax machine as in Example 1 to produce a latent image and is activated as in Example 4.

EXAMPLE 6

A latent image printing substrate is prepared by continuously coating a first sheet of 15 pound weight basis paper having a white background with an integrated layer having a thickness of 3 microns and a melting point of 65° C. of Novalac resin HRJ-4002 and refined paraffin wax.

The coating of the first sheet is placed against a second sheet of plain white paper and the two are inserted in an IBM typewriter having a printwheel impact printing element and ribbon. One page of text is typed on the uncoated face of the first sheet by impacting the uncoated surface thereof through the ribbon, at points corresponding to the text, which types thereon and breaks the film of wax and resin and thus locally transfers same to the facing surface of the second sheet. The second sheet of paper bears a latent image of the text which is invisible to the eye.

The latent image is activated by applying Copikem-1 in liquid form on the facing surface of the second sheet by means of a roller impregnated therewith. The reaction of HRJ-4002 and Copikem-1 in the areas where the wax film has been transferred results in a color change from colorless to blue which is visible against the white background.

EXAMPLE 7

A latent image printing substrate is prepared by continuously coating a first sheet of 5 pound weight basis paper with an integrated layer having a thickness of 1 micron and a melting point of 65° C. of Novalac resin HRJ-4002 and refined paraffin wax.

The coated side of the first sheet is placed against a second sheet of plain white paper and the two are inserted in an ordinary thermal paper first fax machine such that the uncoated side of the thin coated paper of the pair is facing the printing matrix head of the first fax machine. One page of text is transmitted from a second fax machine to the first fax machine. The thermal head of the first fax machine in contact with the thin coated sheet of the pair melts the coating along the profile of the transmitted characters and transfers the material onto the plain paper mate of the pair. At the end of the transmission the plain paper bears a latent image of the transmitted text which is invisible to the eye. The latent image is activated by applying Copikem-1 in liquid form on the facing surface of the plain paper sheet by means of a highlighter pen or a roller. The reaction of HRJ-4002 and Copikem-1 in the areas where the wax film has been transferred results in a color change from colorless to blue which is visible against the white background.

EXAMPLE 8

Everything is the same as in Example 7, in addition the plain paper mate of the pair described above is coated along its left and right margin areas along a one inch width with Copikem-1 mixed into an ordinary binding solution to ensure adherence on the plain paper. Upon transmission of the text from the second fax machine to the first fax machine, any information on the transmitted text from the second fax machine which is in the left and right margin areas will appear immediately visible to the eye on the plain paper of the pair inserted in the first fax machine. Such information can be the name of the addressee or any other relevant information.

EXAMPLE 9

Everything is the same as in Example 8, in addition the first thin sheet of very low basis weight, five pound basis weight, which is naturally or made to be translucent, is adhered at its side edges to the plain paper. Clearly, when this pair of two sheets is acted upon by the first fax machine as described in Example 7 and then released, every process described in Example 7 and 8 will have taken place, that is, a latent image is carried by the plain sheet as well as a visible image developed on selected parts. In addition, the top thin sheet which is glued at the side edges of the plain paper sheet acts as a translucent physical envelope through which the visible image can be seen. However, the presence of the top sheet will prevent the activation of the latent image by anyone but the addressee, since it must be removed to activate the latent image.

What is claimed is:

1. A printing process comprising the steps of:

providing a toner including a resin and only one of a pair of a color developer and color former dye, wherein the color developer and color former dye react when mixed to produce a first spectral response;

applying the toner to at least one first selected area of a substrate to obtain a developed image on the substrate in the at least one first selected area;

thereafter applying the other of the pair to the toner of the developed image when desired in the at least one first selected area to produce the first spectral response when applied.

2. The printing process according to claim 1, wherein the toner is at least quasi-colorless, wherein the step of applying the toner to the at least one selected area produces a latent image and wherein the step of applying the other of the pair produces a visible image.

3. The printing process according to claim 1, further comprising applying the toner to the at least one second selected area when the toner is applied to the at least one first selected area and applying the other of the pair to the substrate in the at least one second selected area prior to the step of applying the toner to produce a visible image in the at least one second selected area.

4. The printing process according to claim 1, wherein the toner has a first color and is visible when applied to the substrate and wherein the first spectral response varies the color of the toner from the first color to a second color to provide authentication.

5. The printing process according to claim 1, wherein the substrate is one of photocopier paper, printer paper and plain paper fax paper.

6. The printing process accordingito claim 1, wherein the toner is one of photocopier, printer and fax toner.

* * * * *